United States Patent [19]

Hou et al.

[11] Patent Number: 5,051,552

[45] Date of Patent: Sep. 24, 1991

[54] SLIDE SELECTOR SWITCH MECHANISM

[75] Inventors: Sheng-Nan Hou, Kaoshiung, Taiwan; Joseph Spedale, Chicago, Ill.

[73] Assignee: Ilinois Tool Works Inc., Glenview, Ill.

[21] Appl. No.: 552,486

[22] Filed: Jul. 16, 1990

[51] Int. Cl.[5] ..... H01H 15/06

[52] U.S. Cl. ..... 200/549; 200/550; 200/257; 200/260; 200/16 C

[58] Field of Search ..... 200/547, 549, 550, 252, 200/257, 260, 291, 16 C

[56] References Cited

U.S. PATENT DOCUMENTS

| | | | |
|---|---|---|---|
| 2,521,468 | 9/1950 | Lodge | 200/16 C |
| 2,666,101 | 1/1954 | Ellithorpe | 200/257 X |
| 2,762,880 | 9/1956 | Hathorn et al. | 200/550 |
| 2,966,560 | 12/1960 | Gluck | 200/550 X |
| 3,461,252 | 8/1969 | Vananzi | 200/252 X |
| 4,128,745 | 12/1978 | Marsilio et al. | 200/16 C |
| 4,210,791 | 7/1980 | Sorenson | 200/550 |
| 4,283,611 | 8/1981 | Bull | 200/252 |
| 4,485,280 | 11/1984 | Matsubara et al. | 200/16 C |
| 4,737,602 | 4/1988 | Yamamoto | 200/252 X |
| 4,764,745 | 8/1988 | Aoi et al. | 200/16 C X |
| 4,825,020 | 4/1989 | Rao et al. | 200/16 C X |

FOREIGN PATENT DOCUMENTS

| | | | |
|---|---|---|---|
| 674504 | 11/1963 | Canada | 200/257 |
| 466309 | 8/1964 | United Kingdom | 200/257 |

*Primary Examiner*—Henry J. Recla
*Assistant Examiner*—Glenn T. Barrett
*Attorney, Agent, or Firm*—Schwartz & Weinrieb

[57] ABSTRACT

A slide selector switch mechanism for use within slide switches for controlling electrical circuits includes a detent spring centrally connected to a slide actuator member and to opposite ends of a movable bridging contactor. The detent spring provides contact pressure for effecting adequate pressurized electrical engagement of the contactor with underlying fixed terminal contact elements. The detent spring also functions as a separate actuating member for causing pivotal movement of the bridging contactor.

17 Claims, 1 Drawing Sheet

SLIDE SELECTOR SWITCH MECHANISM

FIELD OF THE INVENTION

This invention relates generally to miniature electrical switches and more particularly, it relates to a slide selector switch mechanism for use within slide switches for controlling electrical circuits which includes a detent spring centrally connected to a slide actuator and to opposite ends of a movable contactor for pivotably moving or actuating the same.

BACKGROUND OF THE INVENTION

A prior art search directed to the subject matter of this application was conducted in the U.S. Patent and Trademark Office and revealed the following U.S. Letters Patent:

| | | |
|---|---|---|
| 2,802,077 | 4,139,746 | 4,525,607 |
| 3,529,109 | 4,181,825 | 4,764,745 |
| 3,769,870 | 4,404,437 | 4,825,020 |
| 3,993,881 | 4,417,109 | |

In U.S. Pat. No. 3,993,881 to Marsilio, there is disclosed a snap-action slide switch which includes a pivoted rocker arm engaging flexible elements of the insulated slide member of the switch. In U.S. Pat. No. 4,404,437 to Quigley, there is disclosed a molded snap-in switch which includes a movable contact blade which is pivoted at its center and is biased into sliding engagement with first and second spaced contacts by means of a spring which is in contact with a section which is within the vicinity of the pivotal axis of the sliding blade. The switches disclosed in U.S. Pat. Nos. 4,139,746; 4,525,607; and 4,825,020 are generally illustrative of the type of electrical slide switches which includes a flat leaf-like spring attached to a slide actuator wherein the spring also functions as the contactor. The remaining patents uncovered from the search but not specifically discussed merely show the state of the art relating to slide switches and are thus considered to be only of general interest.

However, none of the prior art uncovered in the search disclosed a slide selector switch mechanism which includes a detent spring centrally connected to a slide actuator and to opposite ends of a contactor. The detent spring functions as an actuating member for pivotally moving or actuating the contactor.

OBJECTS OF THE INVENTION

Accordingly, it is a general object of the present invention to provide an improved slide selector mechanism for use within slide switches which is relatively simple and economical to manufacture and assemble.

It is an object of the present invention to provide an improved slide selector switch mechanism which is formed of a reduced number of components than has been traditionally available.

It is another object of the present invention to provide an improved slide selector switch mechanism for use within slide switches which includes a detent spring centrally connected to a slide actuator and to opposite ends of a movable contactor for pivotally moving or actuating the same.

SUMMARY OF THE INVENTION

In accordance with these aims and objectives, the present invention is concerned with the provision of an improved slide selector switch mechanism for use within miniature slide switches which includes an insulating base member having fixed therein spaced, substantially aligned first, second and third terminal contact members. A movable contactor is provided so as to overlie the terminal contact members and is pivotally movable between a first position at which it is in electrically bridging engagement with the first and second terminal contact members but in spaced disengagement from the third terminal contact member and a second position at which it is in electrically bridging engagement with the second and third terminal contact members but in spaced disengagement from the first terminal contact member. A detent spring is operatively connected to the movable contactor so as to resiliently bias with a predetermined amount of contact pressure the movable contactor toward either the first position or the second position. The detent spring also functions as an actuator for causing the pivotal movement of the movable contactor.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout the different views, and wherein.

DESCRIPTION OF THE PREFERRED EMBODIMENT

Figure 1:
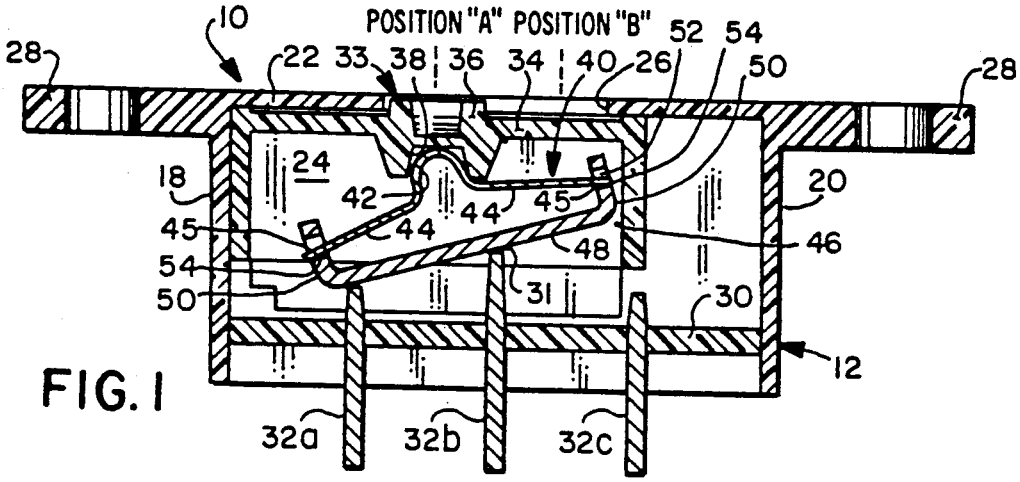
FIG. 1 is a cross-sectional view of a slide selector switch mechanism, constructed in accordance with the present invention and illustrating the slide actuator member, detent spring and bridging contactor in the left endmost position.

Referring now to the various views of the drawings, there is illustrated in FIGS. 1 through 4 a slide selector switch mechanism 10 for use within miniature slide switches and which is constructed in accordance with the principles of the present invention. The switch mechanism 10 includes a rectangularly-shaped housing 12 having parallel side walls 14, 16 (FIG. 4), parallel end walls 18, 20 (FIG. 1), and a top wall 22. The housing 12 is preferably integrally molded from a suitable nonconductive plastic material, such as, for example a polycarbonate. The molded housing further contains a rectangular well 24 defined by means of the side and end walls 14–20 and is substantially open at its lower end. A central elongated aperture or opening 26 is formed within the top wall 22, and a pair of apertured mounting tabs 28 extend outwardly at the opposite ends of the housing top wall 22 for securing the switch mechanism 10 to a suitable mounting structure.

The lower end of the housing 12 is adapted to receive an insulating molded base member or terminal board 30 having fixed therein one or more parallel rows of longitudinally spaced terminal contact elements 32*a*, 32*b*, and 32*c*. In the embodiment illustrated, the base member 30 is provided with only a single row of such fixed contact elements thereby providing a single pole, double-throw switch. However, it should be readily apparent to those skilled in the art that any number of such fixed contact elements may be provided depending upon the number of poles and positions desired. The terminal contact elements are rigidly secured within the molded base member 30, such as, for example, by means of staking or any other desired method and are arranged to lie along a straight line. The terminal contact elements 32*a*, 32*b* and 32*c* are preferably formed from a suitable conductive sheet metal material, such as, for example, a silver-coated copper alloy, and each is preferably formed so as to have a substantially, closed loop, generally oval configuration, as can be best seen from FIG. 4.

Disposed within the rectangular well 24 of the housing between the top wall 22 thereof and the insulating base member 30 is a rectilinearly movable slide actuator member 33 having a rectangular upper slide portion 34 and an upwardly protruding button portion 36 which extends through and is movable along the elongated aperture 26 provided within the housing top wall 22. The slide actuator member 33 with the integral button portion 36 is also preferably integrally molded from a suitable non-conductive plastic material, such as, for example, polycarbonate. It is to be clearly understood that the actuator member 33 is not to be limited to the slide-type actuator shown in the preferred embodiment, but can include other actuators, such as, for example, rocker, paddle, or toggle-type members.

The slide actuator member 33 is provided within its central bottom surface with a pocket or socket 38 within which is suitably mounted for rocking movement a leaf or detent spring 40. The detent spring 40 is formed of a central inverted U-shaped section 42 and a pair of laterally extending arms 44 disposed integrally upon each side of the U-shaped section. A movable bridging contactor 46 is formed of a central portion 48 and upstanding portions 50 formed integrally with the opposite ends of the central portion 48.

The U-shaped section 42 of the detent spring 40 is received within and is pivotally movable within the central pocket 38 formed upon the underneath side of the slide portion 34 of the slide actuator member 33. Each of laterally extending arms 44 of the detent spring 40 includes a finger 45 which extends into corresponding openings 52 formed within the respective upstanding portions 50 of the bridging contactor 46. Shoulders 54 are provided at the bottom of the openings 52, as depicted in FIG. 1. The fingers 45 and the shoulders 54 define interlocking means for fixedly connecting the bridging contactor 46 in assembled relationship with the detent spring 40. The spring 40 and the contactor 46 are made of a suitable resilient conductive sheet material. The spring 40 provides contact pressure for effecting adequately pressured electrical engagement of contactor 46 with the underlying fixed contact members 32*a*, 32*b*, and 32*c*.

Figure 2:
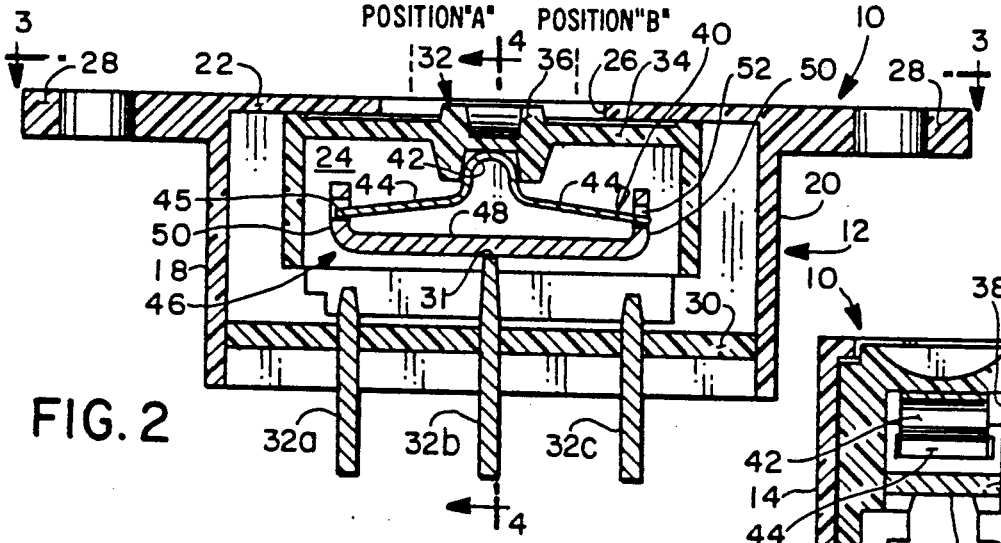
FIG. 2 is a view similar to FIG. 1 taken along the lines 2—2 of FIG. 3, but illustrating the bridging contactor in an unstable dead center position between the left and right endmost positions.
Figure 4:
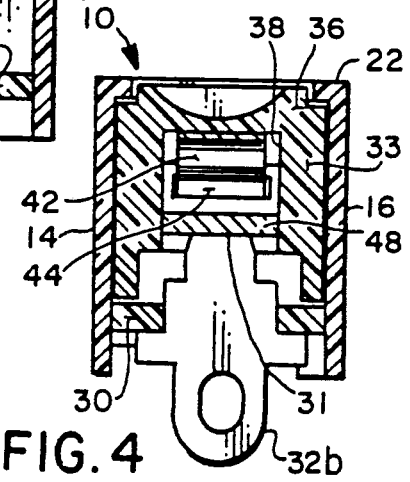
FIG. 4 is a transverse sectional view, taken along the lines 4—4 of FIG. 2.

The upper end 31 of the terminal contact element 32*b* is rigid and serves as a pivotal support member for the movable bridging contactor 46 and is slightly higher than the left endmost terminal contact member 32*a* and the right endmost terminal contact member 32*c*, as viewed in FIGS. 1 and 2. Consequently, the detent spring 40 functions as a driving member or separate actuator for the bridging contactor 46 so as to pivot the same from the position "A," shown in FIG. 1 when the slide actuator member 33 is moved fully to the left, to a position "B" when the slide actuator member 33 is moved fully to the right.

Figure 3:
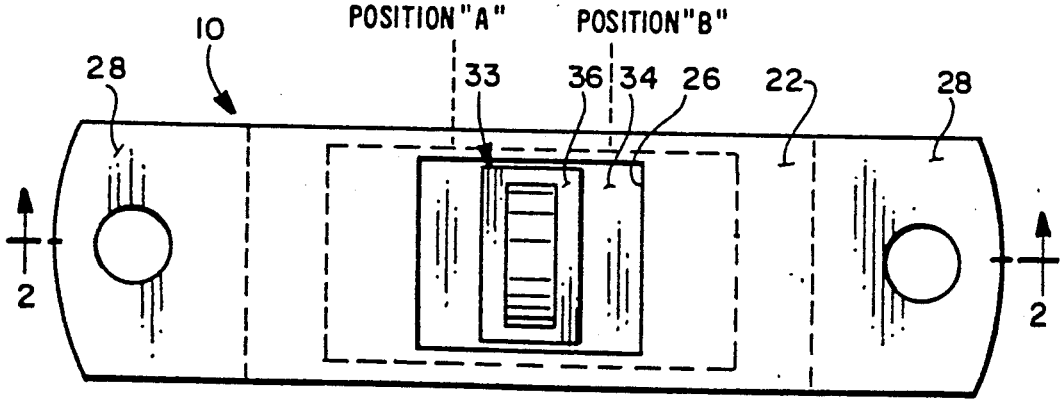
FIG. 3 is a top plan view of the slide selector switch mechanism, taken along the lines 3—3 of FIG. 2.

Having now described the construction of the selector slide switch mechanism 10, as shown in FIGS. 1 through 4, its operation will now be explained. The button portion 36 of the slide actuator member 33 is utilized for simultaneously driving the detent spring 40 and the bridging contactor 46 between the first position "A" illustrated in FIG. 1 and the second position "B," opposite to the position "A" shown in FIG. 1. When the button portion 36 of the actuator member 33 has been slidably moved to the fully left endmost position (position "A") in FIG. 1, the contactor 46 electrically bridges the underlying fixed contact terminal elements 32*a* and 32*b* of the switch mechanism 10. Upon movement of the button portion 36 of the actuator member 33 to the fully right endmost position (position "B"), the contactor 46 will pivot about the central terminal contact element 32*b* acting as a fulcrum so as to transfer the contactor 46 into the right endmost position for electrically bridging the fixed contact members 32*b* and 32*c*. As the actuator member 33 is moved from position "A" to position "B" and vice-versa, it will pass through a central dead center position, as illustrated in FIGS. 2 and 3.

From the foregoing detailed description, it can thus be seen that the present invention provides an improved slide selector switch mechanism which includes a detent spring centrally connected to a slide actuator member and to the opposite ends of a movable bridging contactor. The detent spring provides contact pressure for effecting adequate pressurized electrical engagement of the contactor with the underlying fixed terminal contact elements and also functions as a separate actuating member for moving or pivotably actuating the bridging contactor.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt the present invention to a particular situation or for use in connection with a particular material without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A slide selector switch mechanism for use in miniature slide switches, comprising:

an insulating base member having fixed therein spaced, substantially aligned first, second and third terminal contact elements;

a movable contactor overlying said terminal contact elements and being pivotally movable between a first position at which said movable contactor is in electrically bridging engagement with said first and second terminal contact elements but in spaced disengagement with respect to said third terminal contact element, and a second position at which said movable contactor is in electrically bridging engagement with said second and third terminal contact elements but in spaced disengagement with respect to said first terminal contact element;

actuating means, having a pocket recess defined within a substantially central portion thereof, slidably movable with respect to said insulating base member and said terminal contact elements fixedly mounted therein; and a spring element interconnecting said movable contactor and said actuating means, and comprising a substantially U-shaped portion at a substantially central portion thereof for disposition within said pocket recess of said actuating means so as to serve as a fulcrum for pivotably mounting said movable contactor upon said actuating means such that when said actuating means is slidably moved to a first position, said spring element will resiliently bias said movable contactor to said first position at which said movable contactor electrically bridges said first and second terminal contact elements, while when said actuating means is slidably moved to a second position, said spring element will bias said movable contactor to said second position at which said movable contactor electrically bridges said second and third terminal contact elements.

2. A slide selector switch mechanism as claimed in claim 1, further comprising housing means which includes a rectangularly-shaped housing having a top wall, side walls, and end walls, said housing means being substantially open at its lower end for receiving said base member.

3. A slide selector switch mechanism as claimed in claim 1, wherein said second terminal contact element is slightly higher than said first and third terminal contact elements and serves as a pivotal support member for said movable contactor.

4. A slide selector switch mechanism as claimed in claim 1, wherein said spring element and said movable contactor are formed of suitable resilient conductive sheet metal materials.

5. A slide selector switch mechanism as claimed in claim 1, further comprising molded housing means for enclosing said actuating means, said spring element, and said movable contactor.

6. A slide selector switch mechanism as claimed in claim 5, wherein said actuating means includes a button portion extending through an elongated aperture formed in said molded housing means and being operated in a sliding mode of operation.

7. A slide selector switch mechanism as claimed in claim 6, wherein said spring comprises said U-shaped section which is inverted and a pair of extending arms disposed integrally on opposite ends of said U-shaped section.

8. A slide selector switch mechanism as claimed in claim 7, wherein said movable contactor includes a central portion and upstanding portions formed integrally with opposite ends of the central portion, each of the extending arms of said spring element having a finger extending in corresponding openings formed in the upstanding portions of said movable contactor so as to provide interlocking engagement therewith.

9. A slide switch mechanism, comprising:

housing means;

an insulating base member having fixed therein spaced, substantially aligned first, second and third terminal contact element, said second terminal contact element being interposed between said first and third terminal contact elements and having a height substantially greater than respective height dimensions of said first and third terminal contact elements;

a movable contactor overlying said terminal contact elements and being pivotally movable, upon said second terminal contact element which serves as a pivotable fulcrum, between a first position at which said movable contactor is in electrically bridging engagement with said first and second terminal contact elements but in spaced disengagement with respect to said third terminal contact element and a second position at which said movable contactor is in electrically bridging engagement with said second and third terminal contact elements but in spaced disengagement with respect to said first terminal contact element;

actuating means slidably movable with respect to said insulating base member and said terminal contact elements fixedly mounted therein; and a spring element interconnecting said movable contactor and said actuating means such that when said actuating means is slidably moved to a first position, said spring element will resiliently bias said movable contactor to said first position about said fulcrum defined by means of said second terminal contact element having said greater height dimension at which said movable contactor electrically bridges said first and second terminal contact elements, while when said actuating means is slidably moved to a second position, said spring element will bias said movable contactor to said second position about said fulcrum defined by means of said second terminal contact element having said greater height dimension at which said movable contactor electrically bridges said second and third terminal contact elements;

said housing means enclosing said actuating means, said spring element, and said movable contactor.

10. A slide switch as claimed in claim 9, wherein said housing means comprises a rectangularly shaped housing having a top wall, side walls, and end walls, said housing means being substantially open at its lower end for receiving said base member.

11. A slide switch as claimed in claim 9, wherein said spring element and said movable contactor are formed of suitable resilient conductive sheet metal materials.

12. A slide switch as claimed in claim 9, wherein said housing means is formed of a molded plastic material.

13. A slide switch as claimed in claim 12, wherein said actuating means includes a button portion extending through an elongated aperture formed in said molded housing means and being operated in a sliding mode of operation.

14. A slide switch as claimed in claim 9, wherein said spring element is formed of an inverted U-shaped section and a pair of extending arms disposed integrally on opposite ends of said U-shaped section.

15. A slide switch as claimed in claim 14, wherein said movable contactor includes a central portion and upstanding portions formed integrally with opposite ends of the central portion, each of the extending arms of said spring element having a finger extending in corresponding openings formed in the upstanding portions of said movable contactor so as to provide interlocking engagement therewith.

16. A slide selector switch mechanism for use in miniature slide switches, comprising:

base means having fixed therein spaced, substantially aligned first, second and third terminal contact elements with said second terminal contact element being interposed between said first and third terminal contact elements and having a height dimension which is substantially greater than respective height dimensions of said first and third terminal contact elements;

movable contactor means overlying said terminal contact elements and being pivotally movable, upon said second terminal contact element having said greater height dimension which serves as a first pivotable fulcrum for said movable contactor means, between a first position at which said movable contactor means is in electrically bridging engagement with said first and second terminal contact elements but in spaced disengagement with respect to said third terminal contact element, and a second position at which said movable contactor means is in electrically bridging engagement with said second and third terminal contact elements but in spaced disengagement with respect to said first terminal contact element;

actuating means, having a pocket recess defined within a substantially central portion thereof, slidably movable with respect to said base means and said terminal contact elements fixedly mounted therein; and a spring element interconnecting said movable contactor means and said actuating means, and comprising a substantially U-shaped portion at a substantially central portion thereof for disposition within said pocket recess of said actuating means so as to define therewith a second pivotable fulcrum for pivotably mounting said movable contactor means upon said actuating means such that when said actuating means is slidably moved to a first position, said spring element will pivot about said second pivotable fulcrum and resiliently bias said movable contactor means about said first pivotable fulcrum defined by means of said second terminal contact element having said greater height dimension and to said first position at which said movable contactor means electrically bridges said first and second terminal contact elements, while when said actuating means is slidably moved to a second position, said spring element will pivot about said second pivotable fulcrum and resiliently bias said movable contactor means about said first pivotable fulcrum defined by means of said second terminal contact element having said greater height dimension and to said second position at which said movable contactor means electrically bridges said second and third terminal contact elements.

17. A slide selector switch mechanism as claimed in claim 16, further comprising molded housing means for enclosing said actuating means, said spring element, and said movable contactor means.

* * * * *